US006390794B1

(12) United States Patent
Chin

(10) Patent No.: US 6,390,794 B1
(45) Date of Patent: May 21, 2002

(54) ROTARY PISTON ASSEMBLY

(76) Inventor: Andrew Chin, 11301 SW. 156th St, Miami, FL (US) 33157

( * ) Notice: Subject to any disclaimer, the term of this patent is extended or adjusted under 35 U.S.C. 154(b) by 0 days.

(21) Appl. No.: 09/442,321

(22) Filed: Nov. 22, 1999

(51) Int. Cl.[7] ..... F01C 1/00

(52) U.S. Cl. ..... 418/207; 418/209; 418/226; 418/227

(58) Field of Search ..... 418/207, 209, 418/226, 227

(56) References Cited

U.S. PATENT DOCUMENTS

| | | | | | |
|---|---|---|---|---|---|
| 127,358 | A | * | 5/1872 | Moore et al. | 418/227 |
| 1,257,744 | A | * | 2/1918 | Schorr | 418/207 |
| 2,110,554 | A | * | 3/1938 | Metzler | 418/227 |
| 2,944,533 | A | * | 7/1960 | Park | 418/226 |
| 3,867,912 | A | * | 2/1975 | Parr et al. | 418/227 |

FOREIGN PATENT DOCUMENTS

| | | | | |
|---|---|---|---|---|
| DE | 4319896 | * | 12/1994 | 418/226 |
| GB | 2077857 | * | 12/1981 | 418/227 |
| JP | 45-30386 | * | 10/1970 | 418/207 |
| JP | 59-122795 | * | 7/1984 | 418/209 |
| RU | 546738 | * | 3/1997 | 418/207 |

* cited by examiner

*Primary Examiner*—John J. Vrablik
(74) *Attorney, Agent, or Firm*—Malloy & Malloy, P.A.

(57) ABSTRACT

A rotary piston assembly including a piston housing with a central axis, and an annular chamber defined about the central axis. A pair of pistons are disposed about 180 degrees apart from one another within the annular chamber and rotate about the central axis a first angular velocity. The assembly also includes an abutment housing including a gap defined in its peripheral wall structure, and structured to rotate about an abutment axis at a second angular velocity. The abutment housing overlaps the piston housing and rotates therethrough to define an interior chamber therebetween, the first and second angular velocities being defined relative to one another so that the gap of the abutment housing rotates through the annular chamber when each of the pistons passes into and out of the interior chamber, thereby allowing the pistons to pass into and out of the interior chamber through the gap.

38 Claims, 6 Drawing Sheets

ROTARY PISTON ASSEMBLY

BACKGROUND OF THE INVENTION

1. Field of the Invention

The present invention relates to a rotary piston assembly structured to be usable in a variety of mechanical devices so as to provide a highly effective and efficient piston assembly, which maximizes the continuous output achievable through its utilization of a rotary assembly, while also significantly simplifying the overall mechanical design into a more efficient, versatile, and expandable configuration.

2. Description of the Related Art

For years standard piston assemblies have been utilized in a variety of different configurations so as to provide driving power and/or the compression of fluid in a variety of different fields. Typically, conventional piston assembly operate under a reciprocating movement whereby the movement of the standard piston sequentially expand and contracts a fixed chamber. Naturally, the expansion time during which the piston retracts is a necessary step in order to allow future compression by the piston to take place, and visa versa. As a result, such a conventional piston assembly typically can only operate one half of the time, the remaining time being spent in essentially a reset function. Accordingly, it would be beneficial to provide a mechanical system which does not have such down time.

To this end, and recognizing this problem piston assemblies which require large and/or continuous power outputs typically incorporate the use of a plurality of piston assemblies, sometimes offset from one another. As a result, a certain degree of power and/or mechanical activity is always being undertaken by at least some of the piston assemblies, while other piston assemblies are resetting. Still, however, such a configuration requires large and complex mechanical assemblies to be configured so as to accommodate the large numbers of piston assemblies and effectively drive them in opposing manners with one another. As a result, such assemblies are not conducive to compact and/or high efficiency uses.

Having recognized the general efficiency losses associated with standard piston assemblies, others in the field have attempted over the years to develop rotary assemblies which can provide for continuous outputs and/or driving operation. For example, others have sought to replace standard piston driven engines with rotary engines that seek to take advantage of the mechanical benefits associated with a continuous rotary driving. Much like other devices which seek to take advantage of a rotary action, such rotary engines are often substantially complex assemblies, which have a variety of physical limitations associated with their use. For example, recognizing the compression and expansion that is still required within any type engine assembly, including a rotary engine, conventional rotary engines typically try to solve the problem by utilizing an interior body rotating asymmetrically within an exterior body. This asymmetrical relative rotation is a critical factor in such current rotary engines, as such has generally been considered one of the only physical and effective manners available to achieve the required compression surface against the leading edge of the interior fin structures. As can be appreciated, however, the complex mechanical nature of such rotary engines tends to counter any advantage that is generally achieved from the continuous rotary aspect of the driving and/or pumping cycle.

As a result, it would be highly beneficial to provide a rotary assembly which achieves a mechanical advantage by having one or more pistons continuously rotating in the same direction, but which does not require overly complex and elaborate configurations to provide effective results. Moreover, such rotary piston assembly should be readily expandable and usable in a variety of configurations, including engines, turbines, pumps, etc., wherein piston assemblies are currently utilized and wherein the losses associated with the necessary reciprocating motion of standard pistons are seen as limiting.

SUMMARY OF THE INVENTION

The present invention relates to a rotary piston assembly configured for use in a variety of different applications, including, engines, turbines, pumps, and the like, many of which have traditionally utilized standard reciprocating piston configurations. Looking particularly to the rotary piston assembly of the present invention, it includes a piston housing. The piston housing is structured to contain at least one, but preferably a pair of pistons, and preferably includes a generally circular cross-sectional. Defined within the piston housing is at least one annular chamber. The annular chamber is preferably concentrically disposed about a central axis of the piston housing, and is configured so that the piston may move therethrough as it rotates about the central axis.

Disposed in generally overlapping association with the piston housing is an abutment housing. In particular, the piston housing preferably includes a generally arcuate passage defined therein, and which may receive at least a portion of the abutment housing. As such, the abutment housing, which is structured to rotate about an abutment axis, rotates through the arcuate passage, and accordingly, through the piston housing. As a result of this overlapping engagement, an interior chamber is defined between the abutment housing and the piston housing.

Further defined in the abutment housing is at least one gap. In particular, the gap is defined by a pair of opposing ends, and as a result of rotation of the abutment housing, the gap is also structured to pass through at least the annular chamber of the piston housing.

The piston and the abutment housing are structured to rotate relative to one another at first and second angular velocities, respectively. Preferably, however, the first and second angular velocities are set relative to one another such that the gap of the abutment housing is disposed in the annular chamber upon the piston moving into the interior chamber defined between the abutment housing and the piston housing. Accordingly, passage of the piston into the interior chamber is achieved through the gap. Likewise, the first and second angular velocities are also preferably set relative to one another such that the gap is also positioned within the annular chamber upon the piston moving out of the interior chamber. As a result, upon the piston passing out of the interior chamber, it again passes through the gap.

Accordingly, the abutment housing generally provides a surface which defines a necessary piston chamber and/or against which compression from a leading surface of the piston can take place. Still, however, continuous movement of the piston in its rotary path is not hindered and/or otherwise interrupted by the opposing surface defined by the abutment housing. A mechanical advantage from the rotary piston is thereby achieved, in an efficient and effective configuration.

These and other features and advantages of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 6:
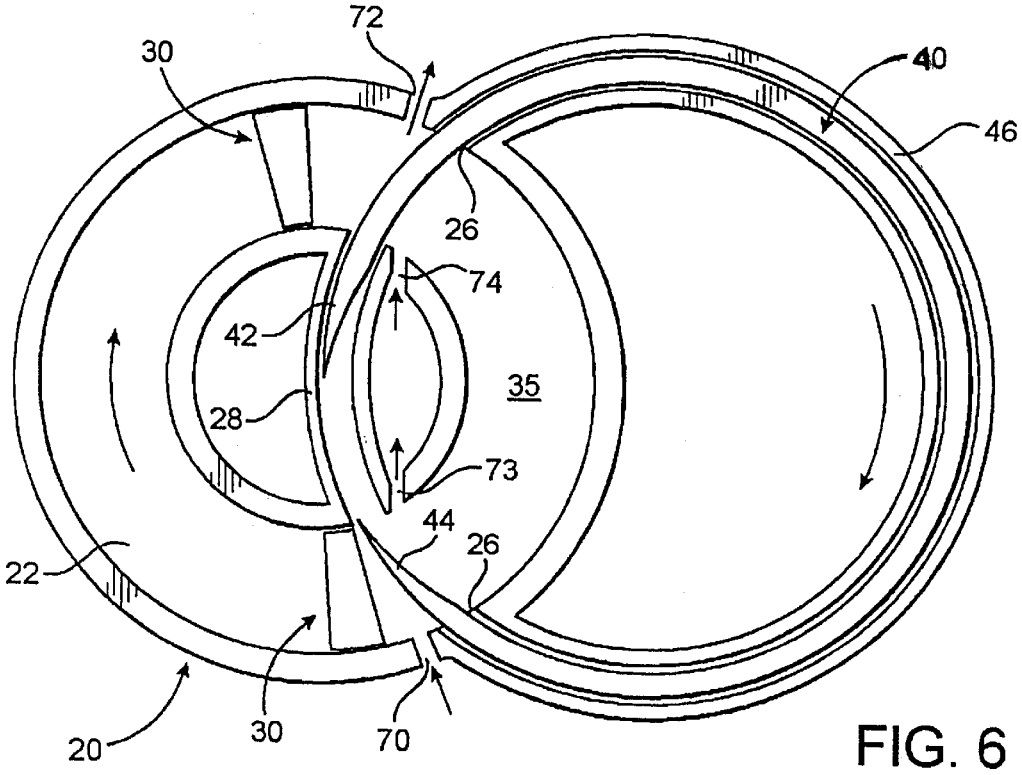
FIG. 6 is a schematic cross-section illustration of the present invention utilized as a pump.
Figure 7:
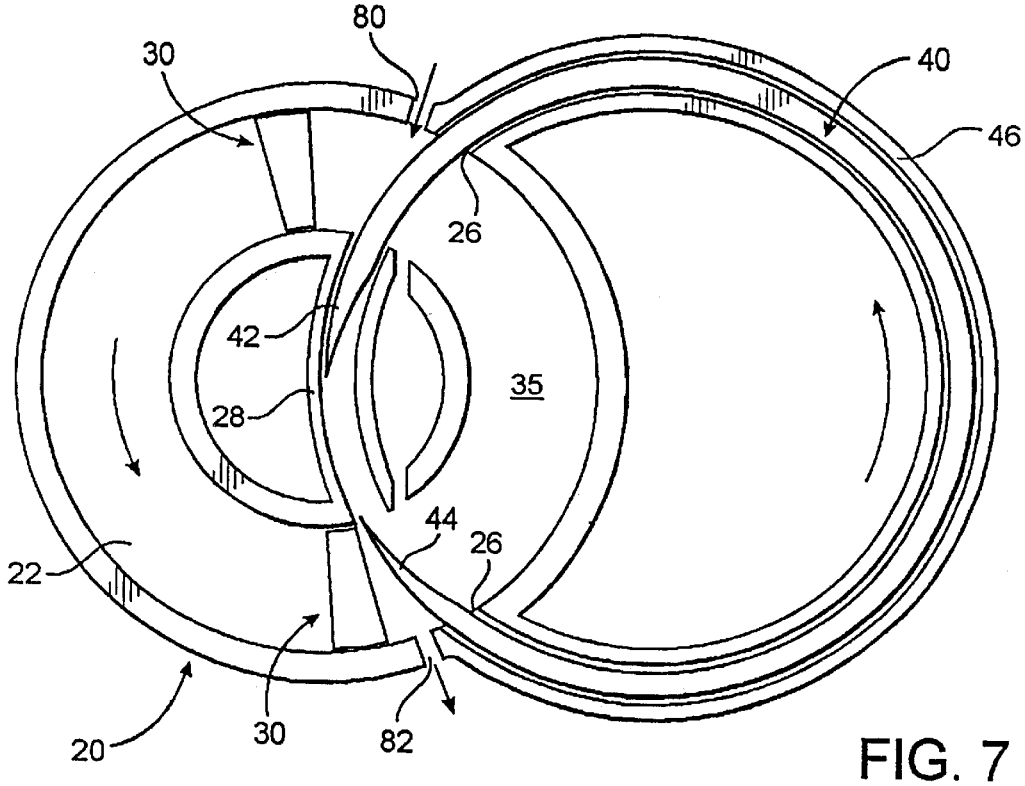
FIG. 7 is a schematic cross-section illustration of the piston assembly of the present invention utilized in a turbine configuration.
Figure 8:
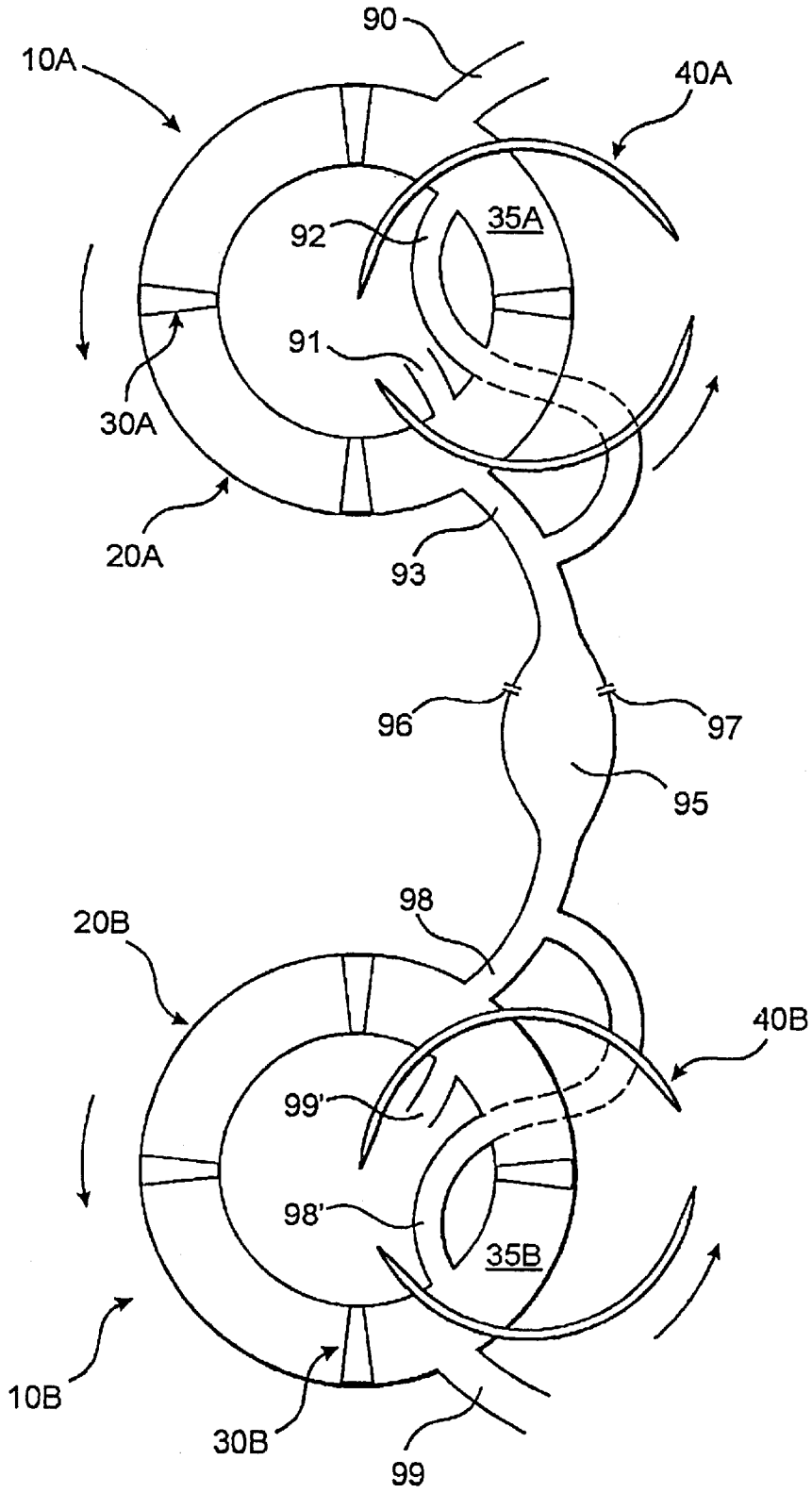
FIG. 8 is a schematic cross-section illustration of the piston assembly of the present invention utilized in an internal combustion engine configuration.

Shown throughout the Figures, the present invention is directed towards a rotary piston assembly, generally indicated as 10. The rotary piston assembly 10 may be incorporated for a variety of different uses, including a fluid pump, as depicted in FIG. 6, a turbine, as depicted in FIG. 7, an internal combustion engine, as depicted in FIG. 8, and a variety of other uses wherein a piston assembly may be utilized.

Looking in particular to the rotary piston assembly 10 of the present invention, it includes a piston housing 20. The piston housing 20 preferably, but not necessarily depending upon the embodiment, includes a generally circular interior, cross-section surface contour. Moreover, defined, preferably as part of the piston housing 20, generally about a central axis 23 is at least one annular chamber 22. The annular chamber 22 preferably defines a generally donut or circular shaped configuration along a cross-section of the rotary piston assembly 10 of the present invention relative to the central axis 23, as depicted in the accompanying Figures. It is noted, however, that the piston housing 20, and as a result the annular chamber 22, in addition to a generally circular cross-section for the annular chamber 22 perpendicular to the central axis may include a generally elongate tubular and/or elliptical type configuration along a length of the central axis 23, and/or may include an overall annular and/or circumferencially tubular configuration about the central axis 23, with any shaped cross section in the plane of the central axis 23. Moreover, the overall size and dimension of the piston housing 20 may be varied depending upon the output and/or input requirement of the system in which the rotary piston assembly 10 will be utilized. However, it is noted, that the effective yet simplistic design to be described hereafter is particularly suited for effective utilization within a small, compact assembly, thereby allowing for the simplification and effective operation of small articles, as well as a larger high output configurations. Additionally, the choice of materials from which the piston housing 20, and the various other components of the present invention to be described, are formed may also vary although, a rigid material, such as a metal, plastics, rigid composite and/or combination thereof, is typically preferred so as to maintain the general integrity of the piston housing 20, and/or the other components during operation of the rotary piston assembly 10.

Movably disposed within the piston housing 20, and preferably within the annular chamber 22 defined about the central axis 23, is at least one piston 30. The piston 30 preferably includes a general length and contour, between its oppositely disposed side ends, that is at least somewhat equivalent to a length and/or contour of the piston housing 20 and annular chamber 22, but includes a general wedge shaped configuration at its cross-section. As a result, the piston 30 will include a leading surface which extends preferably radially across the annular chamber 22, and a trailing surface which also extends preferably radially across the annular chamber 22. Preferably, the aforementioned wedge shape is such that the radially exterior end, which preferably conforms to the radially exterior surface contour of the annular chamber 22, is defined by an arc that is at least slightly larger than the arc which defines the radially interior end, which preferably conforms to the radially interior surface contour of the interior chamber 22.

Also, in the preferred embodiment, and for reasons to be described subsequently, it is preferred that at least a pair of pistons 30 be movably disposed within the annular chamber 22, at a spaced apart distance from one another. Preferably that spaced apart relation is one hundred and eighty (180) degrees so as to provide uniform, opposing movement. In particular, the at least one, but preferably opposing pair of pistons 30 are structured to rotate about the central axis 23 of the piston housing 20 by moving through the annular chamber 22. Furthermore, the pistons 30 preferably rotate in unison with one another through the annular chamber 22, thereby maintaining the predetermining spacing between one another, at a first angular velocity. The first velocity may vary depending upon the particular needs from the rotary piston assembly 10, and in the illustrating embodiment, a preferably uniform first angular velocity is maintained in a direction of rotation. For example, the pistons 30 preferably rotate about the central axis 23 in a first direction, shown in the illustrating embodiments of FIGS. 2A and 2B to be a counter clockwise direction.

The rotary piston assembly 10 of the present invention further includes at least one abutment housing, generally indicated as 40, which rotates about an abutment axis 43. The abutment housing 40 also preferably includes a generally circular cross-section perpendicular to the abutment axis 43, and much like the piston housing 20 may include an elongate tubular configuration along the abutment axis 43, and/or an annular tube type configuration about the abutment axis with any shaped cross section in the plane of the abutment axis 43. The abutment housing 40 is preferably defined by at least a generally rigid peripheral wall structure which follows that circular configuration. Furthermore, the abutment housing 40 includes at least one gap defined in that peripheral wall structure. In particular, the gap is preferably defined by a pair of spaced apart ends 42 and 44 of the peripheral wall structure. Moreover, in the illustrated embodiment a size of the gap is defined by an arc that has an angular dimension that is generally about twice a radial angular thickness of the piston 30.

Figure 2A:
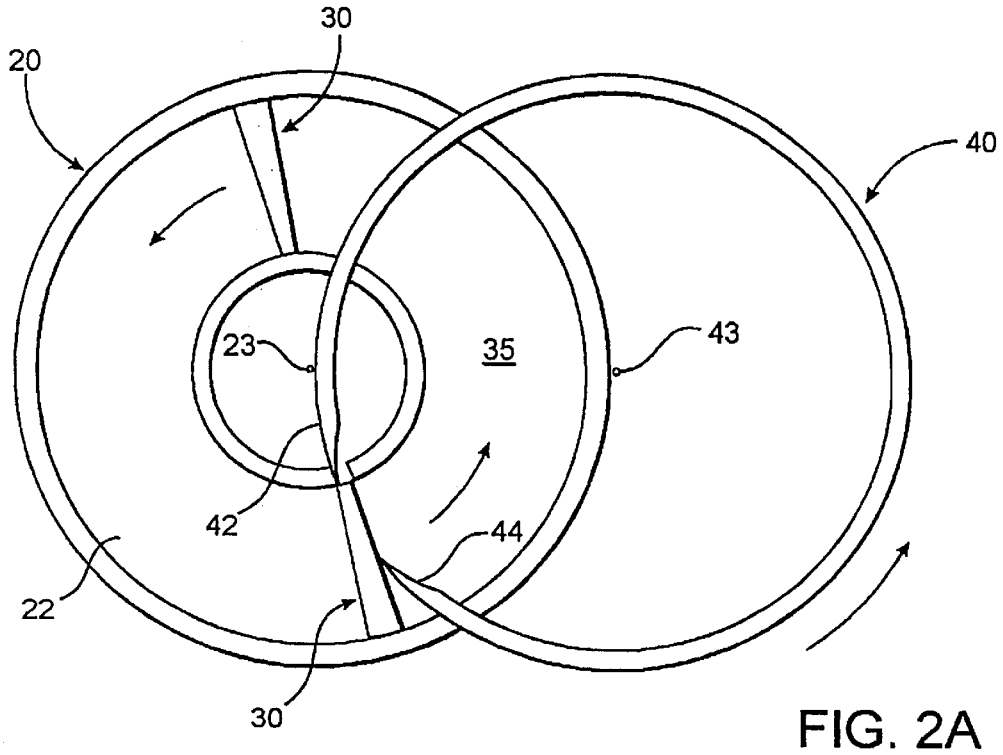
FIGS. 2A and 2B are sequential, cross-sectional illustrations of the rotary piston assembly of the present invention illustrating cooperative passage of the piston through the gap defined in the abutment housing of the present invention.
Figure 2B:
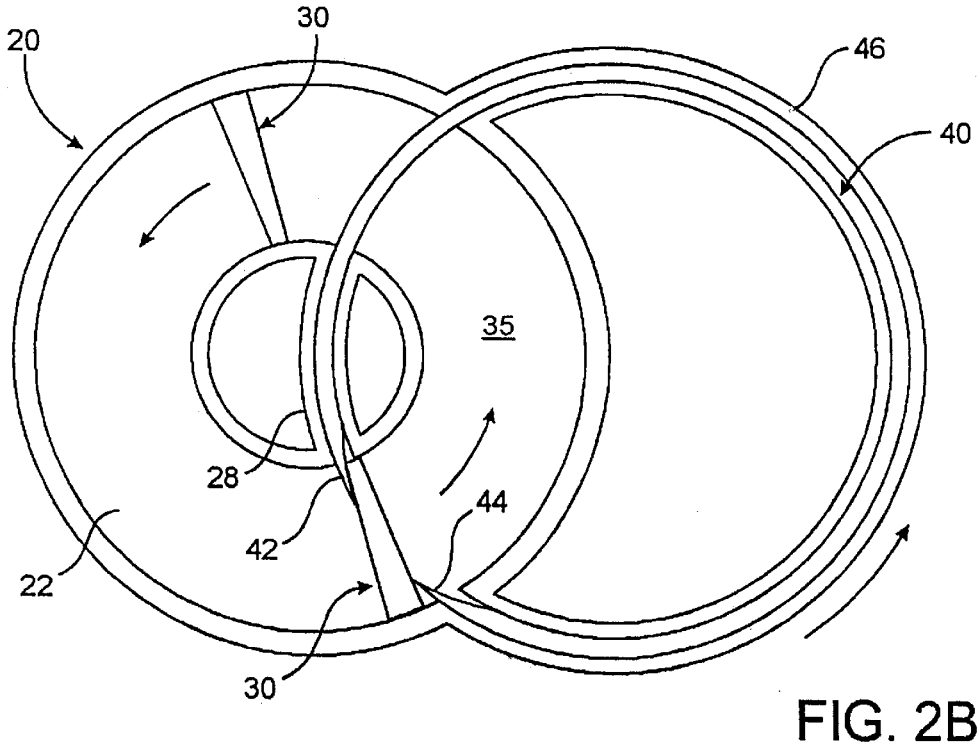

The abutment housing 40 is structured to rotate about the abutment axis 43 at a second angular velocity. Furthermore, the abutment housing 40 is structured to overlap and generally pass through the piston housing 20, as seen in FIGS. 2A and 2B. In particular, the piston housing 20 preferably includes one or more arcuate passages 26, 28 defined therein. The abutment housing 40 is structured to rotate through those passages 26, 28 so as to effectively rotate through and relative to the piston housing 20. Moreover, defined between the overlapping portions of the piston housing 20 and the abutment housing 40 is preferably an interior chamber 35. The interior chamber 35 is defined primarily within the annular chamber 22, and is bordered by the rotating peripheral wall structure of the abutment housing 40. As can be appreciated, however, based upon the rotation of the abutment housing 40 the gap defined by the opposite ends 42 and 44 of the abutment housing 40 will also rotate through the annular chamber 22, and at times will define the opposite ends of the interior chamber 35.

Along these lines, the first and second angular velocity of the piston 30 and abutment housing 40, respectively, are set relative to one another such that the gap defined by the opposite ends 42 and 44 of the abutment housing 40 rotate through the annular chamber 22 of the piston housing 20 substantially simultaneously with the piston 30 passing into the interior chamber 35. Looking specifically to FIGS. 2A and 2B, the abutment housing 40 and the piston 30 preferably, but not necessarily, rotate about parallel axis in the same direction as one another, although the first and second angular velocities, respectively, may be different from one another. Accordingly, as one of the pistons 30 is entering the interior chamber 35, the gap defined by the opposite ends 42, 44 of the abutment housing 40 is preferably simultaneously rotating into the annular chamber 22 to begin to define the entrance of the interior chamber 35. As a result of the timed relative rotation, and preferred sizing of the pistons 30 and the gap in the abutment housing 40, the piston 30 essentially passes through the gap in the abutment housing 40 so as to enter the interior chamber 35 without being obstructed. In this regard, references should be had to FIG. 2A which illustrates how one end 44 of the abutment housing 40 generally passes along the front or leading surface of the piston 30, while the other end 42 of the abutment housing 40 trails towards the trailing surface of the piston 30. As the abutment housing 40 continues to rotate and the piston 30 continues to move, as in FIG. 2B, the end 44 of the abutment housing 40 continues to slide radially outward along the leading surface of the piston 30 until eventually full clearance for the piston is achieved and the piston 30 can pass into the interior chamber 35. Based upon the relative angular velocities and sizing, the piston 30 moves continuously and generally unobstructed into the interior chamber 35. Furthermore, so as to facilitate that slided passage of the ends 42, 44 of the abutment housing 40 over the piston 30, thereby permitting the piston 30 to pass therethrough, the ends 42, 44 are preferably tapered inwardly towards the gap. Moreover, the ends 42, 44, which may be rigid or somewhat resilient, preferably defined a substantially fluid impervious sliding engagement with the piston 30 during the piston's passage through the gap, thereby preserving an integrity of the interior chamber 35 and/or a remainder of the annular chamber 22 in substantial isolation from one another.

Looking further to the illustrated embodiments of the piston housing 20 and the abutment housing 40, the diameter of the abutment housing 40 may be generally equivalent to the diameter of the piston housing 20 at an outer periphery of the annular chamber 22. Furthermore, the piston housing 20 and the abutment housing 40 preferably overlap relative to one another such that the abutment axis 43 is generally aligned with an outer periphery of the annular chamber 22 of the piston housing 20, while the peripheral wall structure of the abutment housing 40 is generally aligned with and passes through the central axis 23 of the piston housing 20.

Also in such an embodiment, the second angular velocity of the abutment housing 40 is preferably twice the first angular velocity of the piston 30. As a result of this relative angular velocity between the abutment housing 40 and the piston 30, not only can the piston 30 effectively slide through the gap defined between the ends 42 and 44 of the abutment housing 40 when entering the interior chamber 35, but the abutment housing 40 will also rotate sufficiently such that the gap will re-enter the annular chamber 22 when the piston 30 is exiting the interior chamber 35. Accordingly, in the same manner that the piston 30 passes through the gap so as to enter the interior chamber 35, the piston 30 passes through the gap once again so as to exit the interior chamber 35, still preserving the isolated integrity of the interior chamber 35 from the rest of the annular chamber 22. As a result of the proceeding, and as will be described in greater detailed subsequently with regard to some specific examples of the use of the rotary piston assembly 10 of the present invention, the abutment housing 40 generally provides a surface against which the piston 30 moves and/or pushes fluid to define a piston chamber, while not restricting and/or otherwise hampering the normal rotary movement of the piston 30 as it continues along it rotary path. Further, in the illustrated embodiment, the second, one hundred and eighty degree offset piston is also provided, the timed rotation between the pistons and the abutment housing 40 being such that when the second piston enters and leaves the interior chamber 35, the gap once again moves into position to permit the entry and exit of the piston 30 therethrough. In addition to ensuring the unhindered movement of the pistons 30 along the rotary path, such a configuration also ensures that a generally sealed isolation is maintained between the interior chamber 35 and the remainder of the annular chamber 22 when gap once again rotates through the annular chamber 22.

Figure 3:
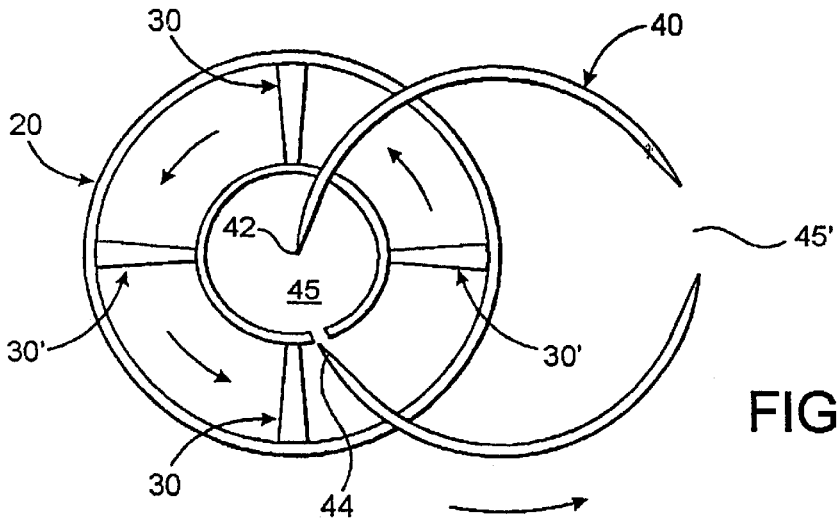
FIG. 3 is a schematic, cross-section illustration of an alternative embodiment of the piston assembly of the present invention incorporating a plurality of pistons and a plurality of gaps defined in the abutment housing.

Although the illustrated preferred embodiment, as depicted in FIGS. 2A and 2B includes a pair of piston 30 disposed at a one hundred eighty degree spacing from one another and a single gap defined in the abutment housing 40, it is understood that a variety of alternate configuration, such as those including one or more gaps and/or one or a plurality of pistons 30, could also be utilized and considered to be within the scope of the present invention. For example, looking specifically to FIG. 3, four pistons 30 and 30' are preferably provided, the pistons 30 and 30' preferably defining two oppositely disposed piston pairs, the corresponding pistons within each pair being spaced one hundred eighty degree apart from one another. Likewise in the embodiment of FIG. 3 a pair of gap 45 and 45' are preferably defined in the abutment housing 40. The gaps 45, 45' are disposed a predetermined distance relative to one another corresponding the spacing between the piston pairs 30 and 30'. For example, in the illustrated embodiment, the gaps are disposed of one hundred eighty degrees apart from one another since the piston pairs 30, 30' are disposed generally ninety (90) degrees from one another. As a result, the rotation of the abutment housing 40 and the pistons 30, 30' in a corresponding uniform direction results in one of the gaps 45 passing through the annular chamber 22 when the first pair of pistons 30 are entering and leaving the interior chamber 35, while the second gap 45' passes through the annular chamber 22 when the second set of pistons 30' are entering and leaving the interior chamber 35. Along these lines, it is noted that although it is preferred that a generally symmetrical orientation between the pairs of pistons 30 and 30' as previously described be maintained, alternate spacings could also be utilized. In such an embodiment wherein the spacing between the piston pairs 30 and 30' is not ninety degrees, and/or is less than ninety degree so that additional piston pairs can be incorporated, the relative orientation of the gaps 45 and 45' relative to one another in the abutment housing 40 would correspondingly be adjusted so as to effectuate proper timed passage of the gaps into the annular chamber 22.

Figure 4:
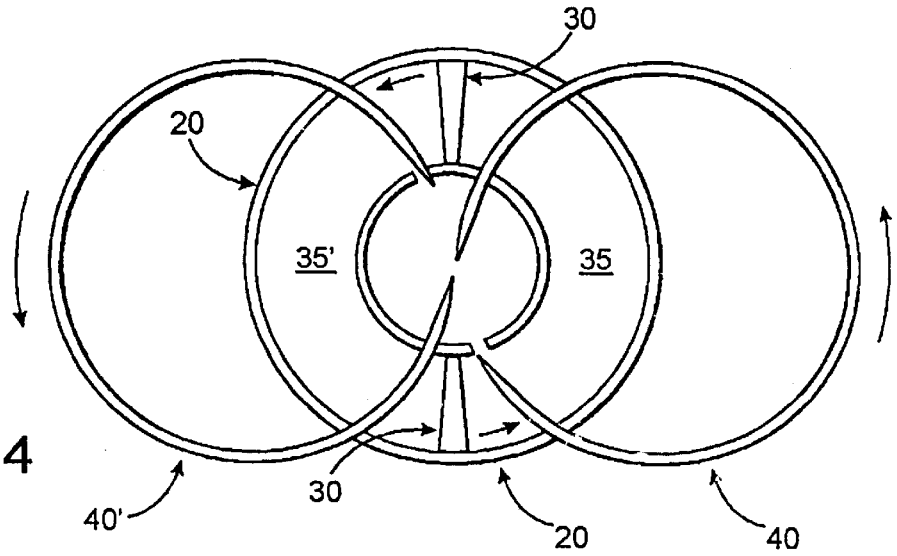
FIG. 4 is a schematic cross-section illustration of an alternative embodiment of the rotary piston assembly of the present invention incorporating a pair of abutment housings.

Turning to FIG. 4, in yet another embodiment a pair of abutment housings 40, 40' may be provided in overlapping relation with a single piston housing 20. In such an embodiment each of the abutment housings 40 and 40' preferably includes a gap defined therein, however, a pair of spaced apart interior chambers 35, 35' are defined within the annular chamber 22 of the piston housing 20. Further, although in the illustration the abutment housings 40, 40' are disposed directly opposite from one another, it is understood that differing, and/or more tangential configurations with two or more abutment housing 40, 40' could also be configured. However, in such an embodiment a more symmetrical configuration is preferred so as to standardize an effective piston stroke achieved by either of the pistons 30. Likewise, it is also noted that a single abutment housing 40 can also be seen to rotate through multiple piston housing 20 in much the same manner that multiple abutment housings 40, 40' rotate through a single piston housing 20. As a result, a generally continuous array of interlocking piston housings 20 and abutment housings 40 could be utilize, if desired, for a particular application.

Figure 5:
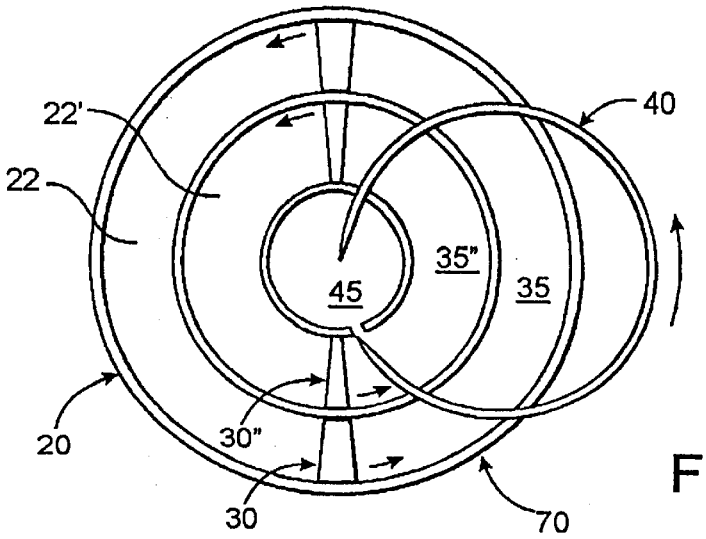
FIG. 5 is a schematic, cross-section illustration of the rotary piston assembly of the present invention including a plurality of concentric annular chambers defined in the piston housing.

Also, looking to FIG. 5, an embodiment wherein a plurality of annular chambers 22, 22' are defined radially from one another within the piston housing 20 may also be provided. in such an embodiment a plurality of integral or separate pistons 30, 30' are correspondingly disposed to move through an appropriate annular chamber 22, 22' and pass into an out of a corresponding plurality of interior chamber 35, 35". In such an embodiment, as well as some others, the diameters of the abutment housing is different from that of the piston housing.

Figure 9:
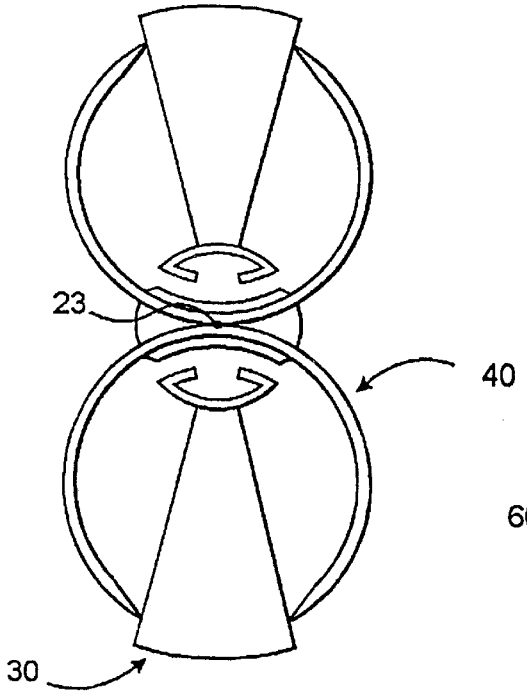
FIG. 9 is a schematic cross-section illustration of yet another alternative embodiment of the rotary piston assembly of the present invention wherein the annular chamber is defined only partially and variably about the central axis of the piston housing between the pistons and the abutment housing.

In yet another embodiment, as defined in FIG. 9, the annular chamber is only partially and/or variably defined about the central axis 23, more precisely being defined directly between the abutment housing 40 and an enlarged piston 30. In such an embodiment, the interior chamber and the annular chamber are generally equivalent, an engagement by the abutment housing along the leading and trailing surfaces of the pistons 30 serving to enclose and define the interior chamber whose radial position moves with rotation of the piston about the central axis.

Figure 10:
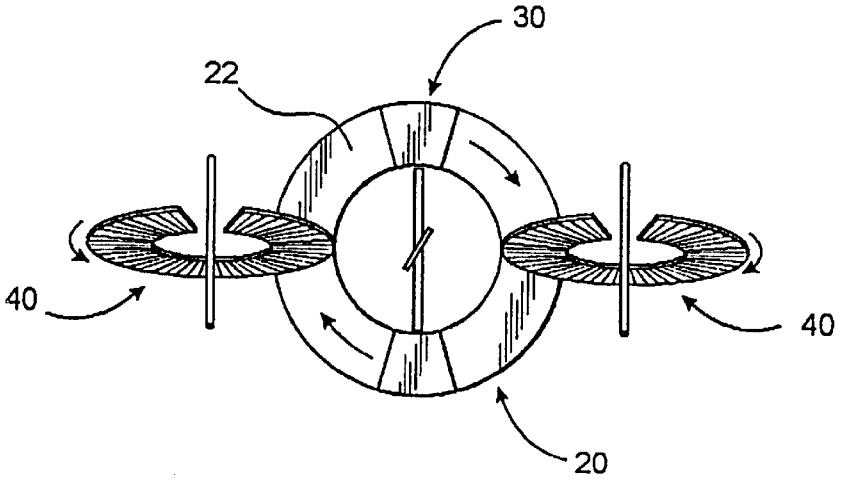
FIG. 10 is a perspective, schematic illustration of yet another embodiment of the present invention wherein a rotational direction of the abutment housing is generally perpendicular to a direction of rotation of the piston.

Furthermore, looking to FIG. 10, it is also recognized that the abutment axis of the abutment housing 40 may be defined perpendicular to the central axis of the piston housing, while still achieving the desired overlap therebetween. Such an embodiment may be beneficial wherein the piston housing includes an annular tubular configuration about the central axis.

So as to preserve a general isolating integrity between the abutment housing 40 and the piston housing 20, an exterior housing 46, which at least partially contains the abutment housing 40 is provided. In particular, the abutment housing 40 is preferably structured to rotate through the exterior housing 46 when not passing through the piston housing 20. As a result, the exterior housing 46 allows for effective rotation of the abutment housing 40 through the piston housing 20, while maintaining overall containment within an interior of the rotary piston assembly 10, as needed.

Figure 1:
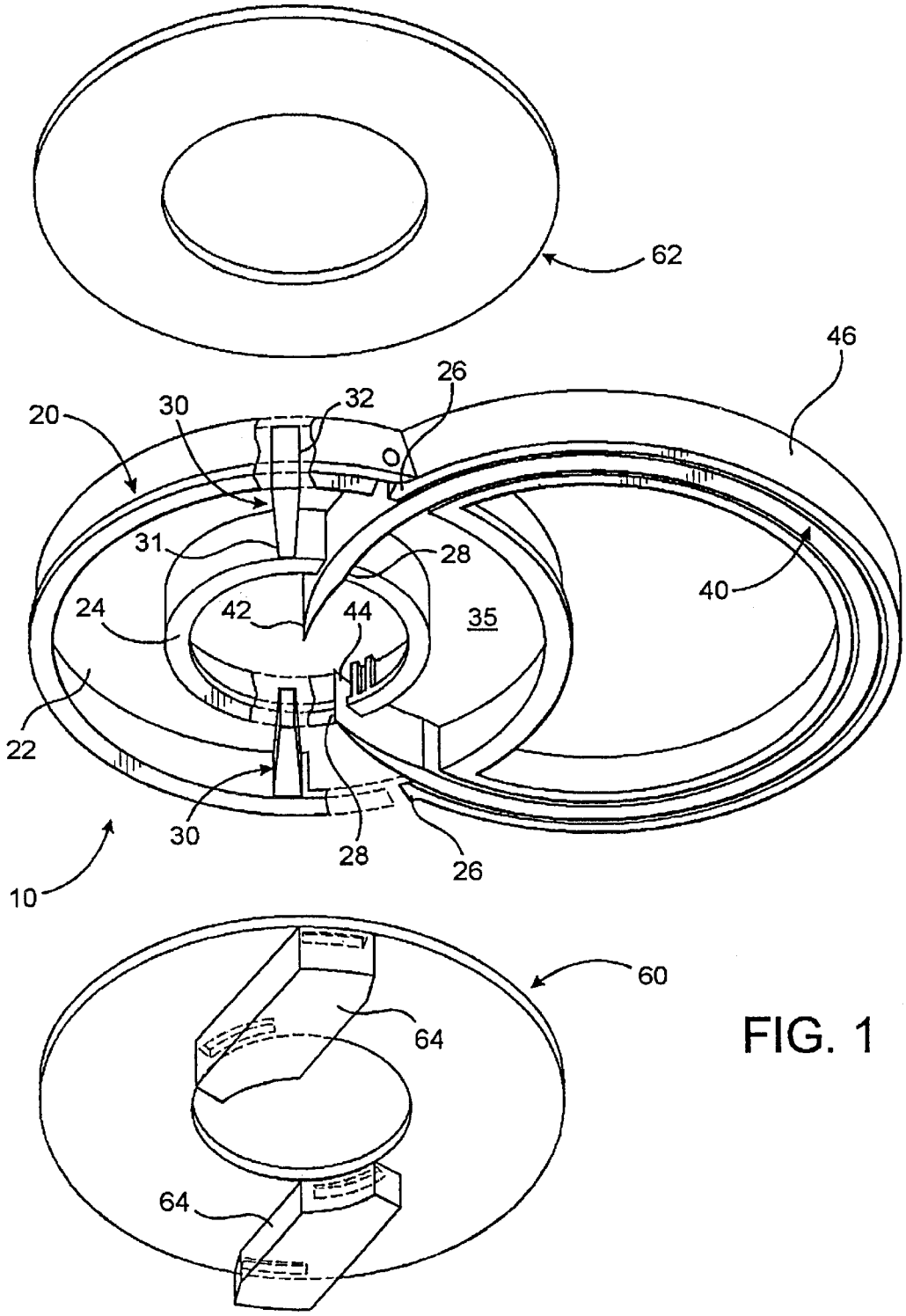
FIG. 1 is a perspective exploded illustration of an embodiment of the rotary piston assembly of the present invention.

Looking once again to the individual pistons 30, the radially interior and exterior ends preferably generally contact and/or are disposed in close spaced apart relation to the interior wall surfaces of the interior chamber 22 in a substantially precise manner, as required so as to maintain the effective and/or typically desirable fluid impervious integrity within the annular chamber 22. Additionally, however, and as best illustrated in FIG. 1 a drive assembly 60 is also preferably provided so as to actually move the pistons 30 through the annular chamber 22, and/or provide a take-off for the rotating energy of fluid driven pistons 30. Because the piston housing 20 is preferably stationery, and the abutment housing 40 preferably rotates through the piston housing 20, the drive assembly 60 preferably includes one or more drive contacts 64 which are structured to operatively engage at least one of the side ends of each of the pistons 30 at an end of the rotary piston assembly 10. As a result, rotation of the drive assembly 60 will not interfere with rotation of the pistons and/or abutment housing 40 through the piston housing 20 and relative to one another. Also in the embodiment of FIG. 1, although a pair of drive assemblies could be provided on opposite ends, a more standard cap structure 62 is preferably provided so as to define an enclosure of the annular chamber 22 between the cap 62 and the drive assembly 60. It is noted that in other embodiments, such as that of FIG. 10, a central drive assembly could be effectively provided.

Figure 11:
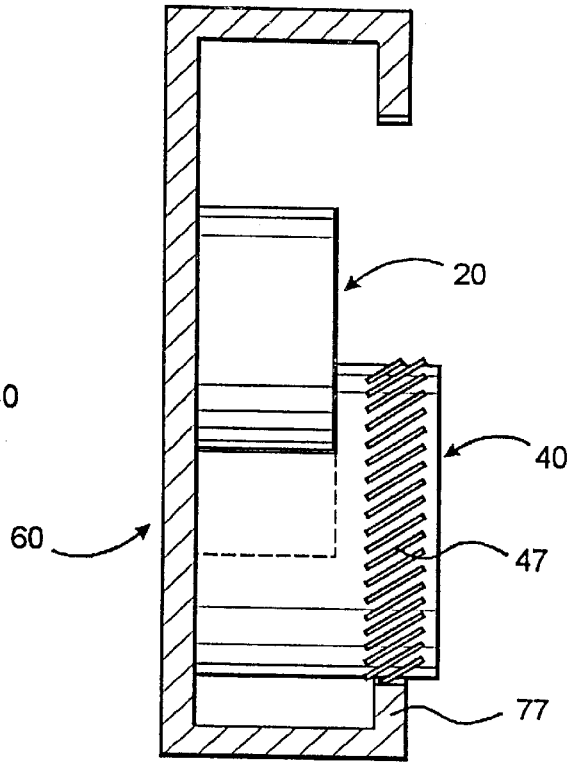
FIG. 11 is a cross-section of a preferred gearing configuration in an embodiment of the present invention.

Turning to FIG. 11, it is also recognized, that if desired a single gearing configuration could be provided to achieve the desired relative rotational angular velocities between the abutment housing 40 and the piston 30. In such an embodiment, the drive assembly 60, which engages the pistons 30 so as to achieve the desired rotational angular velocity, includes a gearing extension 77 which engages a perimeter toothed surface 47 of the abutment housing 40. As a result of the relative dimensions of the gearing, the pistons 30 and the abutment housing 40 can be effectively rotated at desired relative angular velocities utilizing only the drive assembly 60.

As previously described, the rotary piston assembly 10 of the present invention may be integrated within a variety of different operative assemblies. For example, referring first to FIG. 6, the rotary piston assembly 10 of the present invention may be provided as part of a fluid pump. For example, one or more inlets 70, 74 may be provided in the piston housing 20 for the inflow of fluid, whether a liquid or a gas. As the piston 30 rotates through the annular chamber 22, fluid in front of the piston 30 is pushed into and out of the next available outlet 72 or 73 as the abutment housing isolates the interior chamber 35 from the rest of the annular chamber 22 and does not allow continued fluid flow therethrough. Moreover, after each piston 30 passes one of the inlets 70 or 74, a vacuum tends to be formed behind the piston 30 also drawing in additional quantities of fluid and helping to further the cycle. The piston 30 in such an embodiment are preferably driven by a drive assembly 60 such as that depicted in FIG. 1, and continuous movement and pumping rotation of a pistons 30 can be achieved, without the need for a reset motion of the pistons to allow a reciprocating configuration as with conventional piston assemblies.

Looking to FIG. 7, yet another embodiment of the present invention may relate to the integration of the rotary piston assembly 10 of the present invention as part of a turbine assembly. In such an embodiment, a pressurized fluid is introduced into the piston housing 20 through an inlet 80 drives the pistons through the annular chamber 22 until an outlet 82 is reached and the fluid is evacuated from annular chamber 22. Likewise, corresponding inlet and outlet can be provided within the interior chamber 35 so as to provide an effective continuous rotary cycle, or preferably cooling can take place within the interior chamber 35. In such an embodiment, the pistons 30 are connected to the drive assembly, however, it is the rotation of the pistons 30 that causes the movement and rotation of the drive assembly itself so that a conventional power take off can power other portions of an overall machine. By way of example, such a turbine configurations, as depicted in FIG. 7, can also be integrated into an internal combustion configuration, as depicted in FIG. 8, wherein the turbine represented by rotary piston assembly 10B can be in operative communication with preferably a second rotary piston assembly 10A. In particular, in such an embodiment the first rotary piston assembly 10A provides for air compression wherein air or another gas is introduced through one or more inlets 90, 91 and is compressed by the pistons 30A rotating through the piston housing 20A. The air is compressed against the peripheral wall structure of the rotating abutment housing 40A and as a result of the compression is pushed through one or more corresponding outlets 92, 93 in a pressurized state. The compressed air then flows into a combustion chamber 95 wherein fuel is introduced through a fuel supply 96, and an ignition structure 97 ignites and combusts the fuel generating a pressurized gas. The pressurized gas then enters the turbine rotary piston assembly 10B through one or more inlet 98, 98' so as to drive the pistons 30B within the piston housing 20B of the rotary piston assembly 10B. The exhaust gas is then evacuated in a conventional fashion through one or more outlets 99, 99'. In such a configuration, a general cooling preferably takes place in the interior chamber 35B which is isolated from the remainder of the annular chamber of the piston housing 20B by the abutment housing 40B, thereby providing a complete driving cycle in a substantially continuous fashion. Along these lines, it is noted that although a pair of inlets and a pair of outlets is illustrated with regard to each of the rotary piston assemblies 10A and 10B, only one inlet and one outlet, or any appropriate combination thereof, could be effectively utilized in association with the rotary piston assembly 10 of the present invention. Furthermore, this specific illustrated embodiment of the integration of the rotary piston assembly 10 of the present invention is merely an example of one of a variety of uses to which the rotary piston assembly 10 of the present invention can be put.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A rotary piston assembly comprising:

a piston housing, said piston housing including a central axis and at least one annular chamber defined about said central axis;

at least one piston structured to rotate about said central axis within said annular chamber;

said piston structured to move through said annular chamber at a first angular velocity;

at least one abutment housing, said abutment housing including a peripheral wall structure and at least one gap defined in said peripheral wall structure;

said abutment housing structured to rotate about an abutment axis at a second angular velocity;

said abutment housing and said piston housing being overlappingly disposed with one another so as to define an interior chamber therebetween, said abutment housing structured to rotate at least said peripheral wall structure through said piston housing so as to define said interior chamber;

said first angular velocity and said second angular velocity being defined relative to one another such that said gap of said abutment housing rotates through said annular chamber of said piston housing substantially simultaneously with said piston passing into said interior chamber; and said second angular velocity being further defined as substantially twice said first angular velocity.

2. A rotary piston assembly as recited in claim 1 wherein said first angular velocity and said angular second velocity are further defined relative to one another such that said gap of said abutment housing rotates through said annular chamber of said piston housing substantially simultaneously with said piston passing out of said interior chamber such that said piston passes therethrough out of said interior chamber.

3. A rotary piston assembly as recited in claim 1 wherein a diameter of said abutment housing at said peripheral wall structure is generally equal to a diameter of said piston housing at an outer periphery of said annular chamber.

4. A rotary piston assembly as recited in claim 1 wherein said abutment housing and said piston housing are disposed with said central axis aligned with said peripheral wall structure of said abutment housing.

5. A rotary piston assembly as recited in claim 1 further comprising an exterior housing structured to at least partially and rotatably contain said abutment housing.

6. A rotary piston assembly as recited in claim 1 wherein said gap in said abutment housing is defined by a pair of spaced apart ends, each of said ends being generally tapered towards said gap so as to facilitate slided passage over said piston during simultaneous rotational movement of said piston and said abutment housing.

7. A rotary piston assembly as recited in claim 1 wherein said piston housing includes a generally arcuate passage defined therein and structured to at least partially receive said abutment housing rotatingly therethrough.

8. A rotary piston assembly as recited in claim 1 further comprising a plurality of said pistons.

9. A rotary piston assembly as recited in claim 1 further comprising a plurality of said annular chambers concentrically disposed relative to one another.

10. A rotary piston assembly as recited in claim 1 further including a second piston disposed in said piston housing.

11. A rotary piston assembly as recited in claim 10 wherein said second piston is spaced generally about 180 degrees from said first piston.

12. A rotary piston assembly as recited in claim 1 wherein said gap in said abutment housing is defined by a pair of spaced apart ends, said ends structured and disposed to maintain a generally fluid impervious, sliding engagement with said piston during passage of said piston through said gap.

13. A rotary piston assembly as recited in claim 12 wherein said gap is defined by an arc having an angular length that is generally about twice an angular thickness of said piston.

14. A rotary piston assembly as recited in claim 1 wherein said piston comprises a leading surface, a trailing surface, a radially exterior end, a radially interior end, and a pair of oppositely disposed side ends.

15. A rotary piston assembly as recited in claim 14 further comprising a drive assembly structured to move said piston through said annular chamber.

16. A rotary piston assembly as recited in claim 15 wherein said drive assembly is structured to engage at least one of said side ends of said piston so as to move said piston without interfering with said rotation of said abutment housing.

17. A rotary piston assembly as recited in claim 1 further comprising a second abutment housing structured to rotate through said annular chamber of said piston housing so as to define a second one of said interior chambers therebetween.

18. A rotary piston assembly as recited in claim 17 wherein said first interior chamber is spaced apart from said second interior chamber.

19. A rotary piston assembly comprising:

a piston housing, said piston housing including a central axis and at least one annular chamber defined about said central axis;

at least a first piston and a second piston disposed generally about 180 degrees from one another and structured to rotate about said central axis within said annular chamber;

said pistons structured to move through said annular chamber at a first angular velocity;

at least one abutment housing, said abutment housing including a peripheral wall structure and at least one gap defined in said peripheral wall structure;

said abutment housing structured to rotate about an abutment axis at a second angular velocity;

said abutment housing and said piston housing being overlappingly disposed with one another so as to define an interior chamber therebetween, said abutment housing structured to rotate at least said peripheral wall structure through said piston housing so as to define said interior chamber;

said first angular velocity and said second angular velocity being defined relative to one another such that said gap of said abutment housing rotates through said annular chamber of said piston housing substantially simultaneously with each of said pistons passing into and out of said interior chamber, so that said pistons pass into and out of said interior chamber through said gap; and said second angular velocity being further defined as substantially twice said first angular velocity.

20. A rotary piston assembly as recited in claim 19 wherein said gap in said abutment housing is defined by a pair of spaced apart ends, said ends structured and disposed to maintain a generally fluid impervious, sliding engagement with said pistons during passage of said pistons through said gap.

21. A rotary piston assembly comprising:

a piston housing, said piston housing including a central axis and at least one annular chamber defined about said central axis;

at least one piston structured to rotate about said central axis within said annular chamber;

said piston structured to move through said annular chamber at a first angular velocity;

at least one abutment housing, said abutment housing including a peripheral wall structure and at least one gap defined in said peripheral wall structure;

said abutment housing structured to rotate about an abutment axis at a second angular velocity;

said central axis and said abutment axis being substantially parallel with one another;

said abutment housing and said piston housing being overlappingly disposed with one another so as to define at least an interior chamber therebetween, said abutment housing structured to rotate at least said peripheral wall structure through said piston housing so as to define said interior chamber;

said first angular velocity and said second angular velocity being defined relative to one another such that said gap of said abutment housing rotates through said annular chamber of said piston housing substantially simultaneously with said piston passing into and out of said interior chamber;

said second angular velocity being further defined as substantially twice said first angular velocity; and a drive assembly structured to engage said piston so as to move said piston without interfering with said rotation of said abutment housing.

22. A rotary piston assembly as recited in claim 21 further including a second piston disposed in said piston housing at a spacing of generally about 180 degrees from said first piston.

23. A rotary piston assembly as recited in claim 21 wherein said abutment housing and said piston housing are disposed with said central axis aligned with said peripheral wall structure of said abutment housing.

24. A rotary piston assembly as recited in claim 21 wherein said piston comprises a leading surface, a trailing surface, a radially exterior end, a radially interior end, and a pair of oppositely disposed side ends.

25. A rotary piston assembly as recited in claim 24 wherein said abutment housing rotates through said central axis of said piston housing.

26. A rotary piston assembly as recited in claim 25 wherein said gap includes an angular length relative to said abutment axis that is twice an angle between said leading surface and said trailing surface of said piston.

27. A rotary piston assembly as recited in claim 26 wherein said piston includes a general wedge shaped configuration defined between said leading surface and said trailing surface thereof, said leading surface and said trailing surface extending radially across said annular chamber.

28. A rotary piston assembly as recited in claim 27 wherein said gap in said abutment housing is defined by a pair of spaced apart ends, said ends structured and disposed to maintain a generally fluid impervious, sliding engagement with said piston during passage of said piston through said gap.

29. A rotary piston assembly as recited in claim 28 further including a second piston disposed in said piston housing at a spacing of generally about 180 degrees from said first piston.

30. A rotary piston assembly as recited in claim 29 wherein a diameter of said abutment housing at said peripheral wall structure is generally equal to a diameter of said piston housing at an outer periphery of said annular chamber.

31. A rotary piston assembly as recited in claim 29 wherein a radially exterior surface of said annular chamber is defined by said abutment housing.

32. A rotary piston assembly comprising:

a piston housing, said piston housing including a central axis and at least one annular chamber defined about said central axis;

at least one piston structured to rotate about said central axis within said annular chamber in a rotational direction;

said piston structured to move through said annular chamber at a first angular velocity;

at least one abutment housing, said abutment housing including a peripheral wall structure and at least one gap defined in said peripheral wall structure;

said abutment housing structured to rotate about an abutment axis at a second angular velocity in said rotational direction;

said abutment housing and said piston housing being overlappingly disposed with one another so as to define an interior chamber therebetween, said abutment housing structured to rotate at least said peripheral wall structure through said piston housing so as to define said interior chamber;

said first angular velocity and said second angular velocity being defined relative to one another such that said gap of said abutment housing rotates through said annular chamber of said piston housing substantially simultaneously with said piston passing into said interior chamber; and said second angular velocity being further defined as substantially twice said first angular velocity.

33. An assembly as recited in claim 32 wherein said abutment housing is further structured to rotate through said central axis of said piston housing.

34. An assembly as recited in claim 32 wherein said gap in said abutment housing is defined by a pair of spaced apart ends, said ends structured and disposed to maintain a generally fluid impervious, sliding engagement with said piston during passage of said piston through said gap.

35. An assembly as recited in claim 32 further comprising a second piston disposed generally about 180 degrees from said at least one piston and structured to rotate about said central axis within said annular chamber in said rotational direction.

36. A rotary piston assembly comprising:

a piston housing, said piston housing including a central axis and at least one annular chamber defined about said central axis;

at least one piston structured to rotate about said central axis within said at least one annular chamber;

said piston structured to move through said annular chamber at a first angular velocity;

at least one abutment housing, said abutment housing including a peripheral wall structure and at least one gap defined in said peripheral wall structure;

said abutment housing structured to rotate about an abutment axis at a second angular velocity;

said abutment housing and said piston housing being overlappingly disposed with one another so as to define an interior chamber therebetween, said abutment housing structured to rotate at least said peripheral wall structure through said piston housing so as to define said interior chamber;

said first angular velocity and said second angular velocity being defined relative to one another such that said gap of said abutment housing rotates through said annular chamber of said piston housing substantially simultaneously with said piston passing into said interior chamber, and said gap in said abutment housing is defined by a pair of spaced apart ends, said ends structured and disposed to maintain a generally fluid impervious, sliding engagement with said piston during passage of said piston through said gap.

37. A rotary piston assembly as recited in claim 36 wherein said gap is defined by an arc having an angular length that is generally about twice an angular thickness of said piston.

38. A rotary piston assembly as recited in claim 36 further comprising a second piston disposed within said at least one annular chamber generally about 180 degrees from said at least one piston, said second piston structured to rotate about said central axis within said annular chamber.

* * * * *